US006739386B2

(12) United States Patent
Lamich et al.

(10) Patent No.: US 6,739,386 B2
(45) Date of Patent: May 25, 2004

(54) HEAT EXCHANGER WITH CUT TUBES

(75) Inventors: Bernhard Lamich, Esslingen (DE); Viktor Brost, Aichtal (DE)

(73) Assignee: Modine Manufacturing Company, Racine, WI (US)

( * ) Notice: Subject to any disclaimer, the term of this patent is extended or adjusted under 35 U.S.C. 154(b) by 112 days.

(21) Appl. No.: 10/057,480

(22) Filed: Jan. 23, 2002

(65) Prior Publication Data

US 2002/0108742 A1 Aug. 15, 2002

(30) Foreign Application Priority Data

Jan. 26, 2001 (DE) ..... 101 03 570

(51) Int. Cl.[7] ..... F28F 9/02

(52) U.S. Cl. ..... 165/175; 165/173; 165/178; 165/149; 29/890.043

(58) Field of Search ..... 165/173, 175, 165/149, 178; 29/890.043

(56) References Cited

U.S. PATENT DOCUMENTS

| | | | | | |
|---|---|---|---|---|---|
| 4,458,749 | A | * | 7/1984 | Melnyk | 165/175 |
| 4,682,650 | A | | 7/1987 | Potier | |
| 5,457,885 | A | * | 10/1995 | Ohashi et al. | 165/173 |
| 5,535,821 | A | | 7/1996 | Potier | |
| 5,579,832 | A | * | 12/1996 | Le Gauyer | 165/173 |

FOREIGN PATENT DOCUMENTS

| | | | | |
|---|---|---|---|---|
| CH | 378353 | | 7/1964 | |
| DE | 584678 | | 9/1933 | |
| DE | 2061682 | | 7/1971 | |
| DE | 4445590 | | 6/1996 | |
| DE | 19543986 | | 5/1997 | |
| JP | 0060196 | * | 4/1983 | 165/173 |
| JP | 0147287 | * | 6/1989 | 165/173 |
| JP | 405157488 | * | 6/1993 | 165/173 |

* cited by examiner

*Primary Examiner*—Christopher Atkinson
(74) *Attorney, Agent, or Firm*—Wood, Phillips, Katz, Clark & Mortimer

(57) ABSTRACT

A heat exchanger including a core having a plurality of flat tubes with fins between adjacent tubes, the tubes each having flat side walls connected by front and rear walls defining a flow path, all of the walls extending longitudinally between opposite tube ends with the tube side walls defining a first height. First tube end portions in the tube ends of a plurality of the plurality of flat tubes include flat side walls flared apart to define a second height greater than the first height. Second tube end portions in the tube ends of the plurality of the plurality of flat tubes include a longitudinally extending cut through the front and rear walls with the flat side walls flared apart to define a third height greater than the second height. The side walls of adjacent tubes are secured together at the tube ends, and headers connect to the tube front and rear walls at the first and second tube end portions whereby the headers communicate with the tube flow paths.

14 Claims, 5 Drawing Sheets

HEAT EXCHANGER WITH CUT TUBES

BACKGROUND OF THE INVENTION

The present invention is directed toward heat exchangers, and particularly toward vehicle heat exchangers having flat tubes with deformed ends.

Heat exchangers having fins between flat tubes, which tubes are deformed at their ends for connection to headers, are well known in the art.

In some such heat exchangers, the tubes have their ends flared outwardly enabling adjacent tubes to be connected to one another at the ends notwithstanding the fins between the tubes across the length of the tubes. However, particularly when the heat exchanger is used as a radiator for cooling engine coolant, the small diameter of the flat tubes is relatively limited, often in the range of less than 2 mm. In such cases, particularly where the flaring is formed by a cut along the sides of the flat tube, the resulting surfaces along the sides of the tube ends are so small that they can result in unsatisfactory solder (brazed) connections to the sides of the headers or tanks to which they are connected.

DE 195 43 986 A1 shows a structure in which the tube ends are flared together with a header secured to the front and back sides of the tube ends. It is apparent from FIGS. 4 and 6 of DE 195 43 986 A1 that the depth or width of the deformed ends of the flat tubes is reduced to the extent that the headers are much narrower than the fin and flat tube heat exchange core. If the tube width were not as sharply reduced, problems with respect to soldering connections would also increasingly occur there. The spacing between the flat tubes and the height of the fins arranged between them would also necessarily be further reduced, which would cause the tube-header or tube tank connections to undesirably constrain the design parameters used for such critical heat exchange components.

Further, especially when the depth of the fin and flat tube heat exchange core must be limited due to space constraints, for example, in the range from 20 to 30 mm, the headers or tanks may also be undesirably narrowed even further, which can lead to undesirable high pressure loss in the coolant.

The present invention is directed toward overcoming one or more of the problems set forth above.

SUMMARY OF THE INVENTION

In one aspect of the present invention, a heat exchanger is provided including a heat exchanger core having a plurality of flat tubes with fins between adjacent tubes, the tubes each having flat side walls connected by front and rear walls defining a flow path, all of the walls extending longitudinally between opposite tube ends with the tube side walls defining a first height. First tube end portions in the tube ends of a plurality of the plurality of flat tubes include flat side walls flared apart to define a second height greater than the first height. Second tube end portions in the tube ends of the plurality of the plurality of flat tubes include a longitudinally extending cut through the front and rear walls with the flat side walls flared apart to define a third height greater than the second height. The side walls of adjacent tubes are secured together at the tube ends, and headers or tanks connect to the tube front and rear walls at the first and second tube end portions whereby the headers or tanks communicate with the tube flow paths.

In one form of this invention, a longitudinally extending portion of at least one of the side walls is connected to the side wall at an end of an adjacent tube.

In another form of this invention, the first tube end portions are produced by a compression and flaring process.

In still another form of this aspect of the invention, the second tube end portions are produced by at least one separation cut and the bending of least one of the side walls of the plurality of the plurality of flat tubes. In this form, the longitudinally extending cuts in the second tube end portions may terminate before the first tube end portions.

In still other forms of this invention, the second tube end portion is symmetric relative to the flat tube or is asymmetric relative to the flat tube.

In yet another form of this aspect of the invention, the longitudinally extending cuts of the second tube end portions are substantially centered between the longitudinally extending tube side walls.

In still other forms, the side walls of adjacent tubes are secured together at the tube ends by solder, and/or the headers are connected to the tube front and rear walls by solder.

In another aspect of the present invention, a heat exchanger such as described is produced with the second tube end portions formed by flaring apart the tube side walls, with the headers secured to the first tube end portions prior to the flaring apart of the tube side walls to form the second tube end portions.

In still another aspect of the present invention, the heat exchanger as described is produced by flaring apart the first and second tube end portions to define a second height greater than the first height, with the front and rear walls of the second tube end portions thereafter longitudinally cut.

In yet another aspect of the present invention, the heat exchanger as described is produced with the first tube end portions being defined by flaring the side walls apart and compressing the front and rear walls together.

According to another aspect of the present invention, the heat exchanger as described is produced with the front and rear walls compressed together an amount substantially the same as the thickness of the tank walls secured thereto, whereby the depth of the core is substantially equal to the depth of the headers.

DETAILED DESCRIPTION OF THE INVENTION

Figure 1:
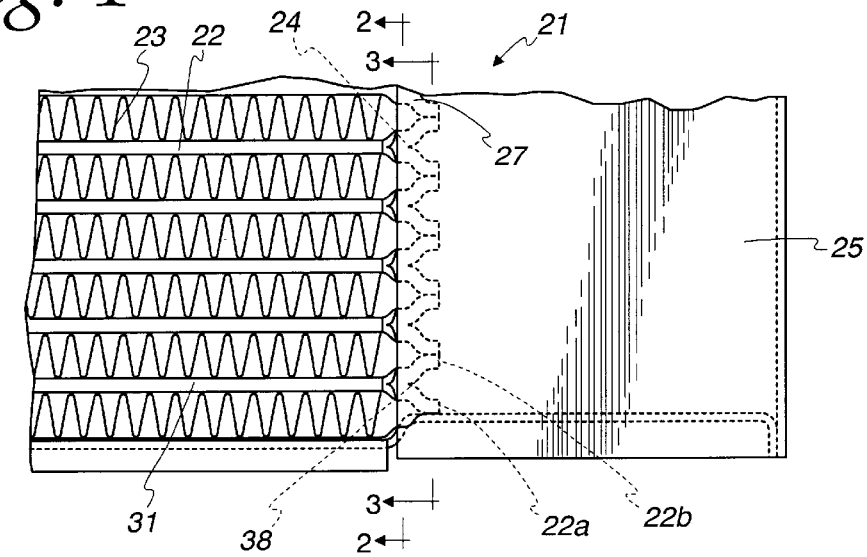
FIG. 1 is a partial side view of a heat exchanger incorporating the present invention.

A heat exchanger 21 constructed according to the present invention is partially shown in FIG. 1, with the heat exchanger 21 including flat tubes 22 spaced apart by serpentine fins 23 to form the heat exchanger core.

Figure 5:
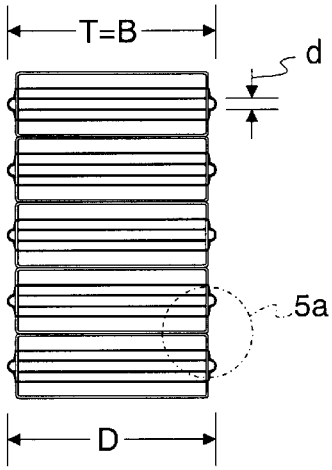
FIG. 5 is a cross-sectional view taken along line 5—5 of FIG. 4.
Figure 5A:
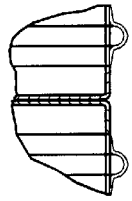
FIG. 5*a* shows detail 5*a* of FIG. 5.

As is known in the art, albeit in a different configuration than with the improved structure of the present invention, the tubes 22 are connected on opposite ends 24 to a pair of tanks or headers 25 (only one of which is shown in FIG. 5) whereby, depending on the flow through the tubes 2, the fluid and/or gas flows either from the tank 25 into the tubes 22 or outlets from the tubes 22 into the tank 25.

As described herein, the components may be made of aluminum clad with solder, typically so-called braze clad alloy, such as is known in the art for bonding and sealing components together through suitable heat processing. However, still other materials could be used within the scope of the present invention. Further, while the illustrated fins 23 are serpentine as shown, still other forms of fins 3, including plate fins, could also be used with the present invention, the fins 23 functioning to transfer heat between the tube interior and the tube exterior. In the case of a radiator, this could involve the cooling of engine coolant within the tubes by blowing ambient air over the tubes 22 and fins 23 of the heat exchanger core. However, the present invention could be used in still other heat exchange applications, such as charge air coolers or possibly even condensers or evaporators, in which still other fluids and/or gases are used.

The tubes 22 generally extend longitudinally with generally parallel flat side walls 26 extending from front to back of the heat exchanger core, with the side walls 26 having a width or depth (major dimension) substantially equal to the depth of the core. The fins 23 are suitably bonded by brazing or soldering to the outer face of the side walls 26. Longitudinally extending front and rear tube walls 31 have a transverse dimension (minor dimension) generally smaller than the flat side walls 26, and connect to the side walls 26 to define a longitudinal flow path therebetween. The flow path may be generally open within the tube, or separate flow paths may be formed in a suitable manner, as is sometimes desired to improve heat exchange efficiency.

The tanks 25 may be of any simple configuration suitable for connecting to the tubes 22 such as described herein, and may be of any suitable shape (such as tubular, box shaped, or combinations thereof) consistent with the connection to the tubes 22. In that regard, the tanks 25 have two connecting edges 27 which overlap with the front and rear tube walls 31 on their ends. Specifically, the connecting edges 27 overlap the end portions of the tubes 22 as described below.

In the embodiment illustrated in FIGS. 1–7, the ends 24 of the flat tubes 22 have two different graduated or flared portions 33, 34. The first flared portion 33 may be produced by a compression and flaring process, with the side walls 26 flared apart and the front and rear walls 31 compressed slightly together. The second flared portion 34 may be produced by a single separation cut 38 through both of the narrow front and rear walls 31, of flat tubes 22 and by bending (see reference numeral 39 in FIG. 4) one or both of the separated tube parts 22*a*, 22*b* of the second flared portion 34.

Figure 3:
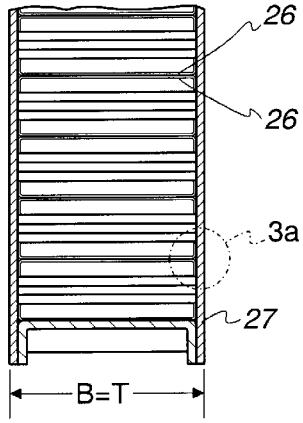
FIG. 3 is a cross-sectional view taken along line 3—3 of FIG. 1.
Figure 2A:
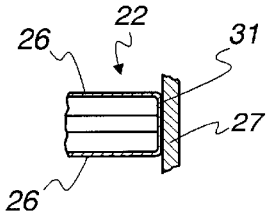
FIG. 2*a* shows detail 2*a* of FIG. 2.
Figure 3A:
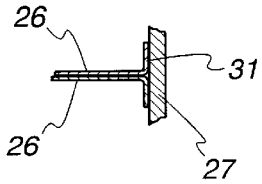
FIG. 3*a* shows detail 3*a* of FIG. 3.
Figure 4:
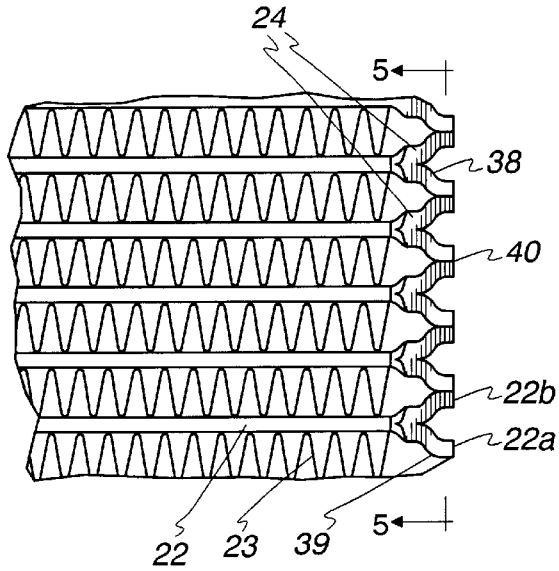
FIG. 4 is a partial side view of the FIG. 1 heat exchanger without tanks.

By compressing the front and rear walls 31 together an amount approximately equal to the thickness of the connecting edges 27, the width B of the headers 25 may be made to correspond to the depth T of the core, as is shown in FIG. 3 and also follows from FIG. 5, which shows the core without the tanks 25. As a result, heat exchangers 21 made according to the present invention may be compactly made to fit in confined areas, such as is often required in vehicular and other applications. As one example, a radiator for a vehicle can be made with a depth/thickness of about 25 mm, with flat tubes 22 having a small dimension (height, "d" in FIG. 5) less than 2 mm such as can be advantageously used for heat exchange efficiency.

Figure 2:
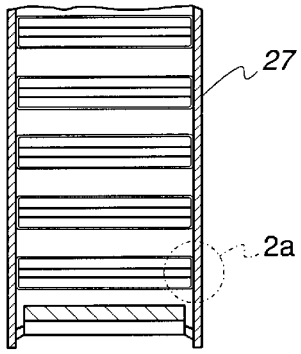
FIG. 2 is a cross-sectional view taken along line 2—2 of FIG. 1.

FIG. 2 shows a section through FIG. 1 arranged roughly in the region of the first flared portion or graduation 33 on the ends 24 of the tubes 22 and just above the graduation 33. The graduation 33 forms as a result of the compression and flaring process. FIG. 3 shows another section through FIG. 1 that runs just above the second flared portion or graduation 34, that is, through the connection surfaces 40 that are formed by the side walls 26 of adjacent flat tube ends 24 lying against each other. The graduation 34 is produced as a result of bending 39 of tube parts 22*a* and 22*b*. The degree of deformation of the compression and flaring process may be much lower than in prior heat exchangers, that is, the major dimension (width) D of the flat tube 22 is much less reduced and the minor dimension (height) d is much less expanded. The deformation section 42 therefore could also easily extend more deeply into the flat tube 22 than shown in FIGS. 6 and 7. Because of this, even larger surfaces would be available for soldering connection between the narrow front and rear walls 31 and the connection edges 27.

Figure 6:
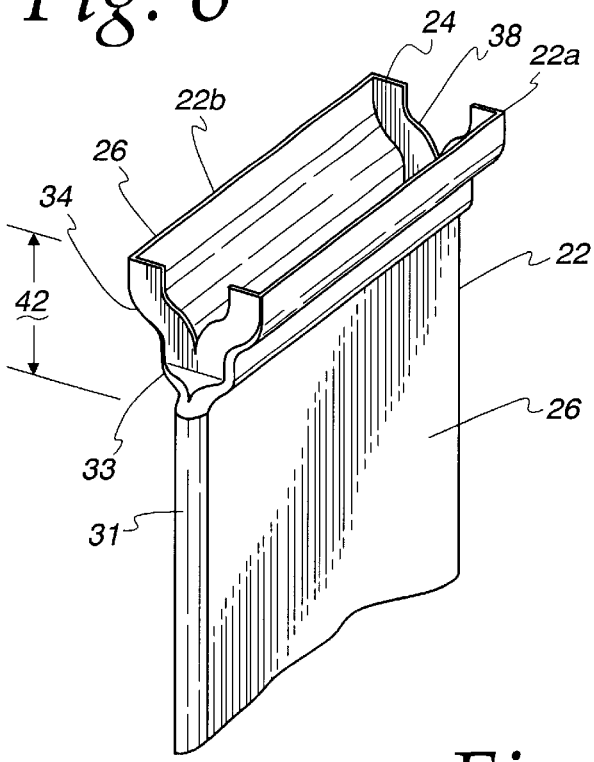
FIG. 6 is a perspective view of a flat tube end in the FIG. 1 embodiment.
Figure 7:
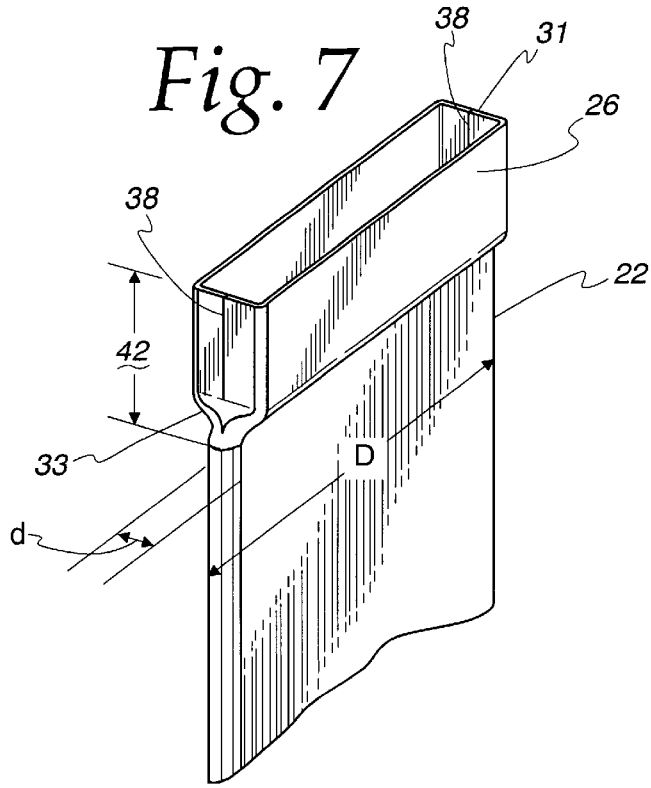
FIG. 7 is a perspective view of a flat tube end during an intermediate stage of manufacture prior to the finished stage illustrated in FIG. 6.

The result of the described process step (flaring process) is shown in FIG. 7. The figure also shows the single separation cut 38 in the practical examples, which is made in the center in the narrow front and rear walls 31 of flat tube 22 within deformation section 42. The separation cut is much shorter than the deformation section 42. Thereafter the two tube parts 22*a* and 22*b* are bent, as shown in FIG. 6, and the second flared portion 34 is formed.

Figure 8:
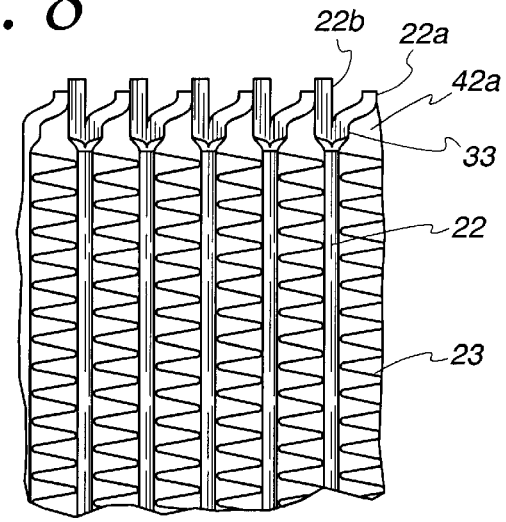
FIG. 8 is a partial side view of a second embodiment of the present invention.
Figure 9:
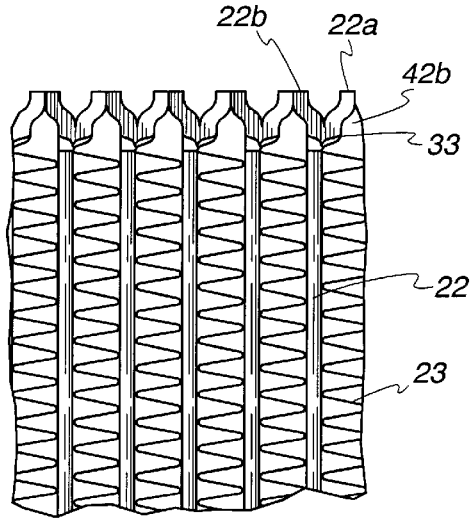
FIG. 9 is a partial side view of a third embodiment of the present invention.
Figure 10:
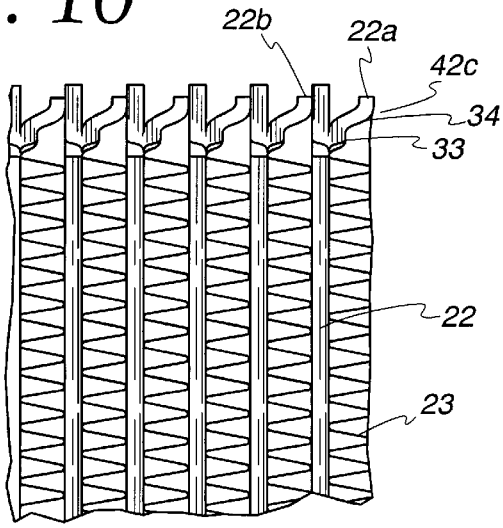
FIG. 10 is a partial side view of a fourth embodiment of the present invention.

FIGS. 8–10 illustrate alternate embodiments of the deformation section 42*a*, 42*b*, 42*c*.

In FIG. 8, the deformation section 42*a* is initially formed symmetrically to the flat tube 22, for example by a compression and flaring process such as described above (and as also shown in FIG. 7). The single separation cut 38 is also made, as previously described, with part 22*a* being bent and part 22*b* remained undeformed.

FIGS. 9–10 show embodiments similar to the FIGS. 1–7 and FIG. 8 embodiments, except that the deformation sections 42*b*, 42*c* in the FIG. 9 and FIG. 10 embodiments are formed asymmetrically to flat tube 22.

The dimensional configuration of flared portions 33, 34 and the depth of the deformation section 42 can be varied from that which is shown, with a wide variety of configurations available to the designer. The flared portions 33, 34 lead to a gentle transition for the coolant on entering the flat tube 22, and they therefore contribute to a reduction in pressure loss.

Figure 11:
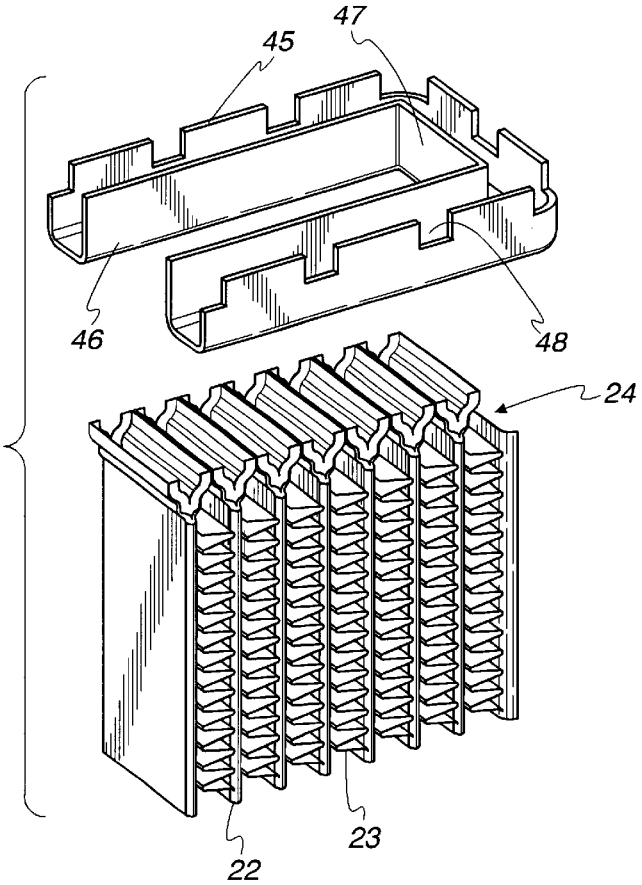
FIG. 11 is a perspective exploded view of a fifth embodiment of the present invention.
Figure 12:
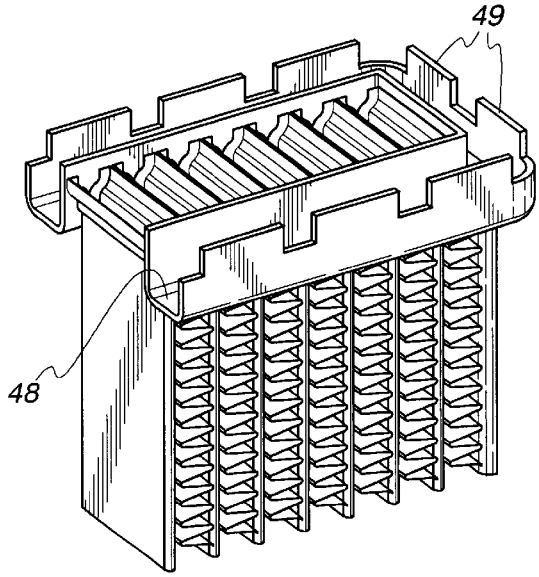
FIG. 12 an assembled view of the FIG. 11 embodiment.

FIGS. 11 and 12 illustrate still another variation of the present invention, with the connection edges 27 of the tanks 25 replaced by a four-sided header frame 45. The header frame 45 has longitudinal and transverse sides 46, 47 and is pushed over the ends 24 of flat tube 22 and connected on the ends 24 in a soldering operation together with all other parts. This modification permits the use of a tank 25 made of plastic. The frame 45 has a U-shaped cross section, as shown in FIGS. 11 and 12, to define a peripheral trough 48 which allows for receipt of the peripheral edge of a tank (not shown) which may then be fastened within the trough 48 of the header frame 45. For example, as illustrated, the frame 45 includes brackets 49 which may be bent to suitably secure a suitable tank tightly in the header frame 45.

Of course, still other header constructions for fastening to the heat exchanger core could be used consistent with the above description of the present invention. For example, the frame 45 could be secured to the first flared portion 33, with the second flared portion 34 formed by a flaring process thereafter.

Still other available modifications to the above described embodiments should be apparent to a skilled artisan having an understanding of the present description. For example, several separation cuts 38 could be made, in which case at least a third part of the deformation section 42 would be provided (in addition to parts 2*a* and 2*b*). Such a third part could be a center part which remains undeformed. As another example, the separation cuts 38 could be replaced by a cut-out in both narrow sides 31. Such alternatives could have particularly application to, as one example, air-cooled charge air coolers. DE 100 60 006.9 is hereby fully incorporated by reference, including its disclosure of such modifications.

It should thus be appreciated that since the ends 24 of the flat tubes 22 are initially deformed, then may be cut and separated, with at least one of the separated parts 22*a*, 22*b* then bent, the spacing between the flat tubes 22 and thus the range of choice for appropriate fins 23 can be significantly expanded by changing the dimensional configuration of the bends. Further, wider narrow front and rear walls 31 are produced on the ends of the flat tubes 22 and the soldering quality of the front and rear walls 31 to the connection edges 27 of the headers 25 is therefore improved. This allows the use of heat exchangers 21 which have flat tubes 22 with a very small minor dimension d while still ensuring that sufficient soldering surface will be available to secure the tubes to the headers 25.

Further, by combining the compression and flaring operations with the separation and bending process, heat exchangers 21 with limited core depths can be provided without requiring that tanks or headers be narrower than the core depth. This can be accomplished because the flaring operation can be more limited (i.e., it does not require as high a degree of deformation as in prior structures), which means that not as large constrictions are present on the transition from the deformed sections of the flat tube. Undesirable pressure drop in the coolant which can result from too narrow headers can therefore be avoided.

Still further, since the tube end deformation can be less, the depth of the deformation section 42 and the length of the separation cut 38 on each end 24 of the flat tube 22 can also be increased so that the variety of design possibilities is significantly expanded. Of course, producing the separation cut 38 (if done after the compression and flaring process) may be simplified as well since the cut 38 may more simply be made, particularly for small tubes 22, in expanded front and rear walls 31 (as particularly illustrated in FIG. 7).

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

We claim:

1. A heat exchanger, comprising:

a heat exchanger core having a plurality of flat tubes with fins between adjacent tubes, said tubes each having flat side walls connected by front and rear walls defining a flow path, all of said walls extending longitudinally between opposite tube ends with said tube side walls defining a first height;

first tube end portions in said tube ends of a plurality of said plurality of flat tubes, said first tube end portions including said flat side walls flared apart to define a second height greater than said first height;

second tube end portions in said tube ends of said plurality of said plurality of flat tubes, said second tube end portions including a longitudinally extending cut through said front and rear walls with said flat side walls flared apart to define a third height greater than said second height;

said side walls of adjacent tubes being secured together at said tube ends; and headers or tanks connected to said tube front and rear walls at said first and second tube end portions whereby said headers or tanks communicate with said tube flow paths.

2. The heat exchanger of claim 1, wherein said securing together of said side walls of adjacent tubes comprises a longitudinally extending portion of at least one of said side walls on at least one of said first and second tube end portions of each tube, said longitudinally extending portions being connected to the side wall at an end of an adjacent tube.

3. The heat exchanger of claim 1, wherein said first tube end portions are produced by a compression and flaring process.

4. The heat exchanger of claim 1, wherein said second tube end portions are produced by at least one separation cut and the bending of least one of the side walls of said plurality of said plurality of flat tubes.

5. The heat exchanger of claim 1, wherein said longitudinally extending cuts in said second tube end portions terminate before said first tube end portions.

6. The heat exchanger of claim 1, wherein said second tube end portion is symmetric relative to the flat tube.

7. The heat exchanger of claim 1, wherein said second tube end portion is asymmetric relative to the flat tube.

8. The heat exchanger of claim 1, wherein said longitudinally extending cuts of said second tube end portions are substantially centered between said longitudinally extending tube side walls.

9. The heat exchanger of claim 1, wherein said side walls of adjacent tubes are secured together at said tube ends by solder.

10. The heat exchanger of claim 1, wherein said headers or tanks are connected to said tube front and rear walls by solder.

11. A method of producing the heat exchanger of claim 1, wherein said second tube end portions are formed by flaring apart the tube side walls and said headers or tanks are secured to said first tube end portions prior to the flaring apart of the tube side walls to form the second tube end portions.

12. A method of producing the heat exchanger of claim 1, wherein said first and second tube end portions are first flared apart to define a second height greater than said first height, with said front and rear walls of said second tube end portions thereafter longitudinally cut.

13. A method of producing the heat exchanger of claim 1, wherein the first tube end portions are defined by flaring said side walls apart and compressing said front and rear walls together.

14. A method of producing the heat exchanger of claim 13, wherein said front and rear walls are compressed together an amount substantially the same as the thickness of the header or tank walls secured thereto, whereby the depth of the core is substantially equal to the depth of the headers or tanks.

* * * * *